US005868347A

United States Patent [19]

Paul et al.

[11] Patent Number: 5,868,347

[45] Date of Patent: Feb. 9, 1999

[54] ROLLED MATERIAL HOLDER AND DISPENSER

[75] Inventors: Gary A. Paul, Ossining; Jonathan B. Paul, Scarsdale, both of N.Y.; Richard J. Paul, Teaneck, N.J.

[73] Assignee: Paul Decorative products, Inc., Bronx, N.Y.

[21] Appl. No.: 914,725

[22] Filed: Aug. 19, 1997

[51] Int. Cl.[6] ..... B65H 16/06; B65H 18/04

[52] U.S. Cl. ..... 242/596.4; 242/596.8

[58] Field of Search ..... 242/596.4, 591, 242/596.8

[56] References Cited

U.S. PATENT DOCUMENTS

| | | | |
|---|---|---|---|
| 2,948,486 | 8/1960 | Epeneter | 242/596.4 |
| 4,553,710 | 11/1985 | Pool | 242/596.4 |
| 4,662,576 | 5/1987 | Paul | 242/596.4 |

OTHER PUBLICATIONS

U.S. Design Appln. No. 29/075,508, filed Aug. 19, 1997, of Gary A. Paul et al., entitled "Roll Holder".

*Primary Examiner*—John Q. Nguyen
*Attorney, Agent, or Firm*—Darby & Darby

[57] ABSTRACT

A rolled material holder includes rotatable disks as base members with pivotable arms for holding opposing open ends of a cylinder having a roll of material. The rotatable disks allow an installer to mount the holder on any surface without limitation to being just horizontal or just vertical. Each of a pair of side frame members has a cavity, and the disks are positioned in the cavities and have a selectable orientation within the respective cavity of the side frame members. Each base member has a recess in which are mounted a pair of arms for holding the cylinder at the opposing open ends.

4 Claims, 3 Drawing Sheets

FIG. 2B
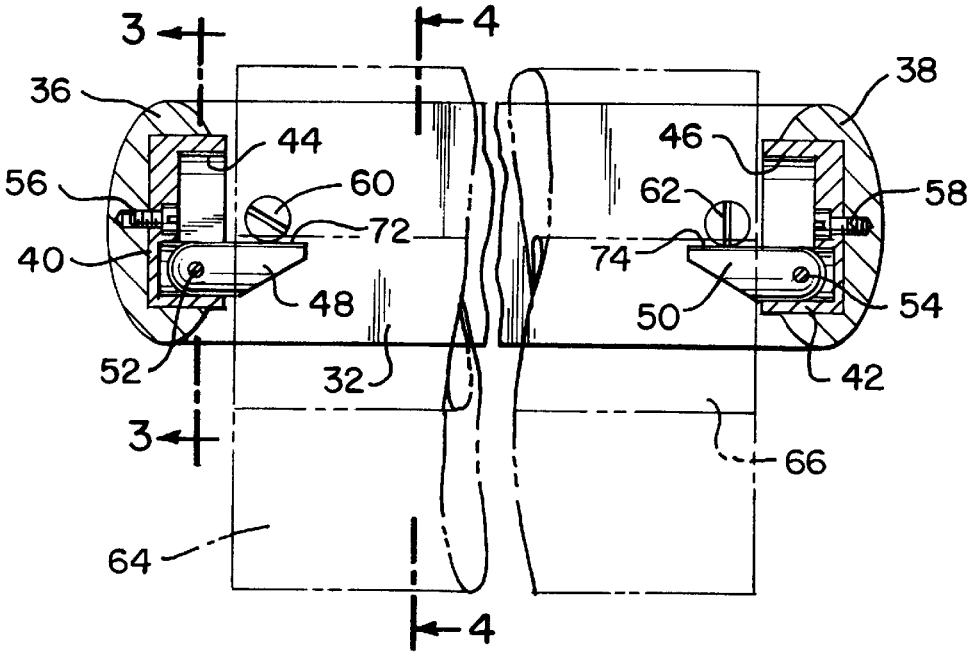
FIG. 2C
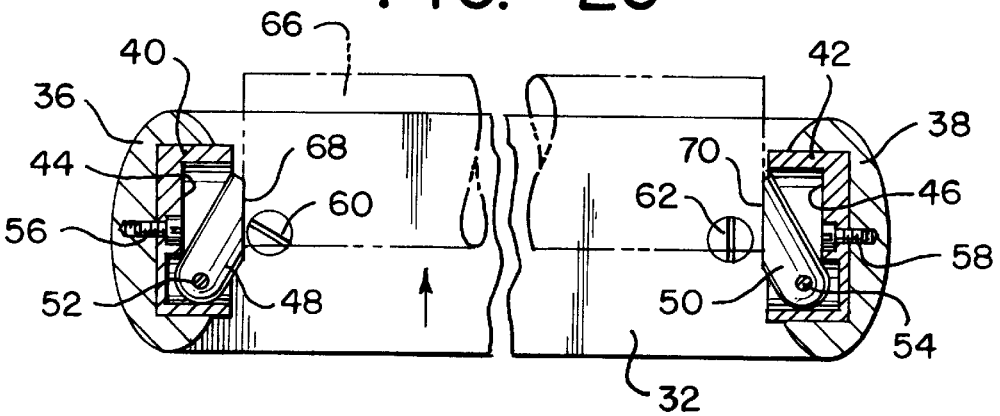
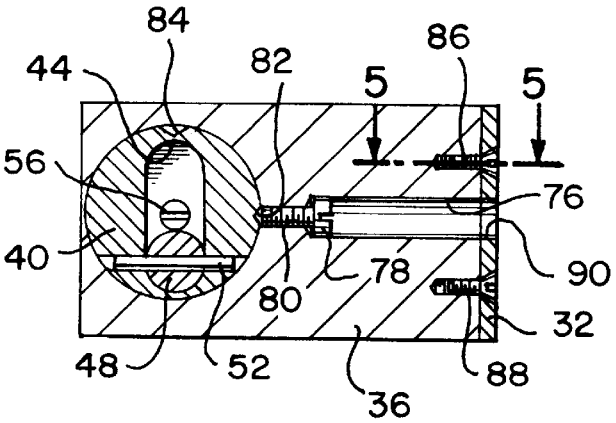
FIG. 3

FIG. 4
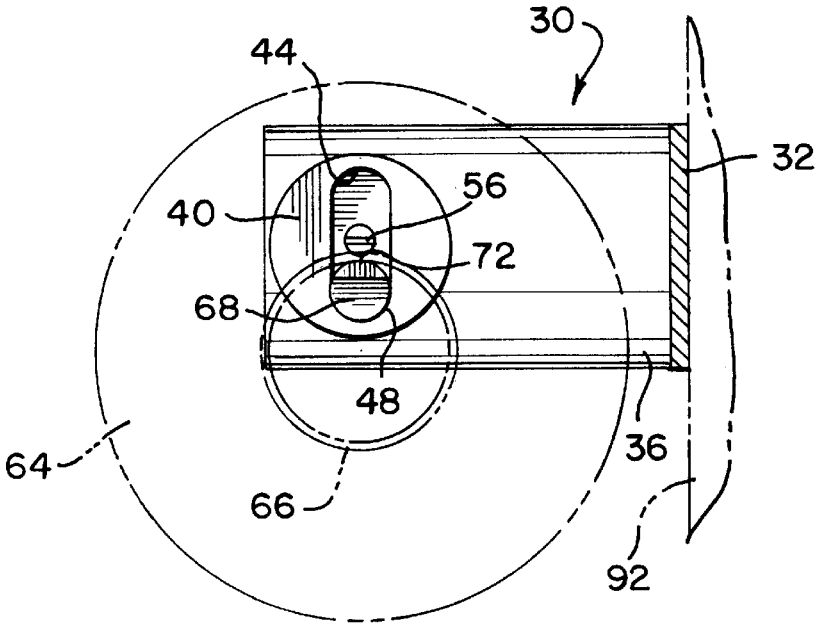
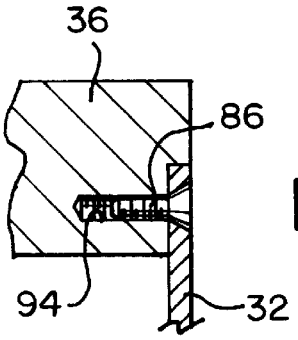
FIG. 5
FIG. 7
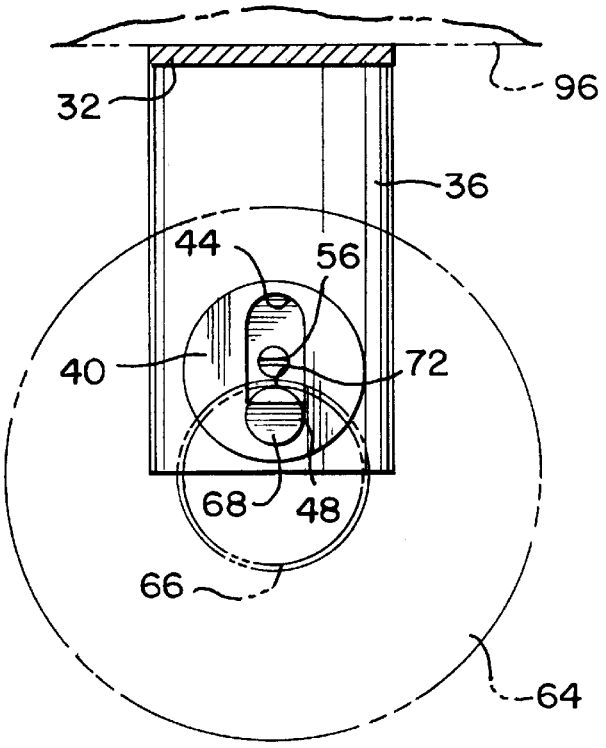
FIG. 6
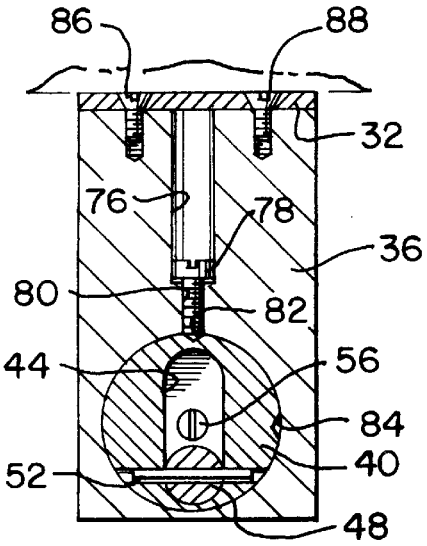

ROLLED MATERIAL HOLDER AND DISPENSER

BACKGROUND OF THE INVENTION

1. Field of the Invention

This disclosure relates generally to the field of dispensers of goods, and in particular to a holder for mounting and dispensing rolled materials.

2. Background

Holders are known in the art for holding rolls of materials; for example, paper towels, toilet paper, wax paper, sheets of aluminum foil, webs of plastic for wrapping food, and the like. A rolled material holder in the prior art typically includes a mounting plate with screw holes or other devices for mounting the holder to a surface; for example, a wall or the underside of a kitchen cabinet. Side frame members extend from the mounting plate and include respective arms which engage openings in a cylindrical core about which the material is rolled. The arms hold the roll between the side frame members and allow rotation of the roll and its material to dispense the material from the roll. Contacting surfaces of the arms may be smooth and/or curved to reduce friction in the rotation of the roll to facilitate the dispensing of the material off of the roll held by the arms.

In some prior art rolled material holders, the side frame members are pivotable to increase the separation of the side frame members for insertion of new rolls of material and replacement of spent rolls. In other prior art rolled material holders, the arms are positioned in cavities in the side frame members. The arms are pivotal so that each arm may be moved from an initial position to be recessed within its cavity in a pivoted position. By pivoting the arms, the spacing between the arms is increased to allow a new roll of material to be inserted and/or spent rolls to be replaced. The arms may then pivot back to the initial position to hold a new roll of material.

The construction of these rolled material holders in the prior art limits their orientation. For example, the holder is specifically oriented in a predetermined configuration to have the side frame members in a horizontal position, and especially with the contacting surfaces of the arms positioned upward so that a roll of material may be positioned upon the contacting surfaces with less resistance to rolling. One can install the holder in any other orientation, for example, horizontally but upside-down relative to the predetermined orientation or vertically with the mounting plate flush against the underside of, for example, a kitchen cabinet. These deviations from the predetermined orientation of the holder will have the contacting surfaces oriented differently, and the roll of material will not properly contact the contacting surfaces for ease of dispensing of the material. The prior art rolled material holders have limited orientation, and so installers and users are limited in their choice of the position and orientation of the holders for users to dispense and receive the rolled material.

SUMMARY OF THE INVENTION

According to the invention, a rolled material holder includes rotatable disks as base members with pivotable arms for holding opposing open ends of a cylinder having a roll of material. The rotatable disks allow an installer to mount the holder on any surface without limitation to being just horizontal or just vertical. Each of a pair of side frame members has a cavity, and the disks as a pair of base members are positioned in the cavities and have a selectable orientation within the respective cavity of the side frame members. Each base member has a recess in which are mounted a pair of arms for holding the cylinder at the opposing open ends.

BRIEF DESCRIPTION OF THE DRAWINGS

The features and advantages of the disclosed rolled material holder are explained with reference to the following detailed description of the preferred embodiment of the present invention, taken in conjunction with the accompanying drawings, in which:

FIG. 2B is a front cross-sectional view of the disclosed holder along lines 2—2 of FIG. 1 holding an inserted roll of material;

FIG. 2C is a front cross-sectional view of the disclosed holder along lines 2—2 of FIG. 1 with the empty cylindrical core of the roll being removed from the holder;

FIG. 3 is a side cross-sectional view of a side frame member of the disclosed holder along lines 3—3 shown in FIG. 2B configured for horizontal mounting of a roll;

FIG. 4 is a side cross-sectional view of a mid-section of the disclosed holder along lines 4—4 shown in FIG. 2B;

FIG. 5 is a top cross-sectional view of a joint between components of the disclosed holder along lines 5—5 shown in FIG. 3;

FIG. 6 is an alternative side cross-sectional view of a side frame member of the disclosed holder along lines 3—3 shown in FIG. 2B configured for vertical mounting of a roll; and FIG. 7 is an alternative view of the mid-section of the disclosed holder along lines 3—3 shown in FIG. 2B in a vertical orientation.

DESCRIPTION OF THE PREFERRED EMBODIMENT

Figure 1:
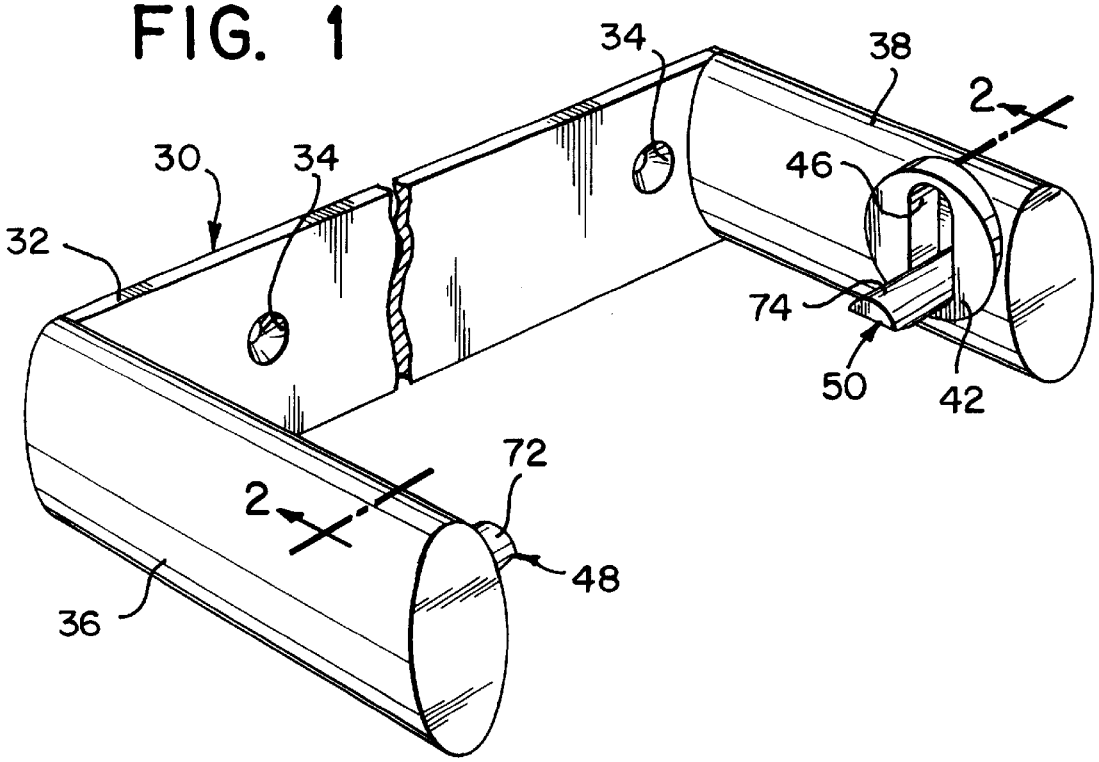
FIG. 1 is a perspective view of the disclosed holder.

As shown in FIG. 1, the invention comprises a rolled material holder 30 which may be mounted on any surface in any orientation without limitation to being just horizontal or just vertical. The holder 30 includes a mounting plate 32 with screw holes 34 for receiving screws to mount the holder 30 against a surface, for example, a wall or the underside of a kitchen cabinet. Side frame members 36, 38 are mounted to or integrally formed with the mounting plate 32 to extend away from the mounting plate 32 and the surface to which the mounting plate 32 is secured.

Figure 2A:
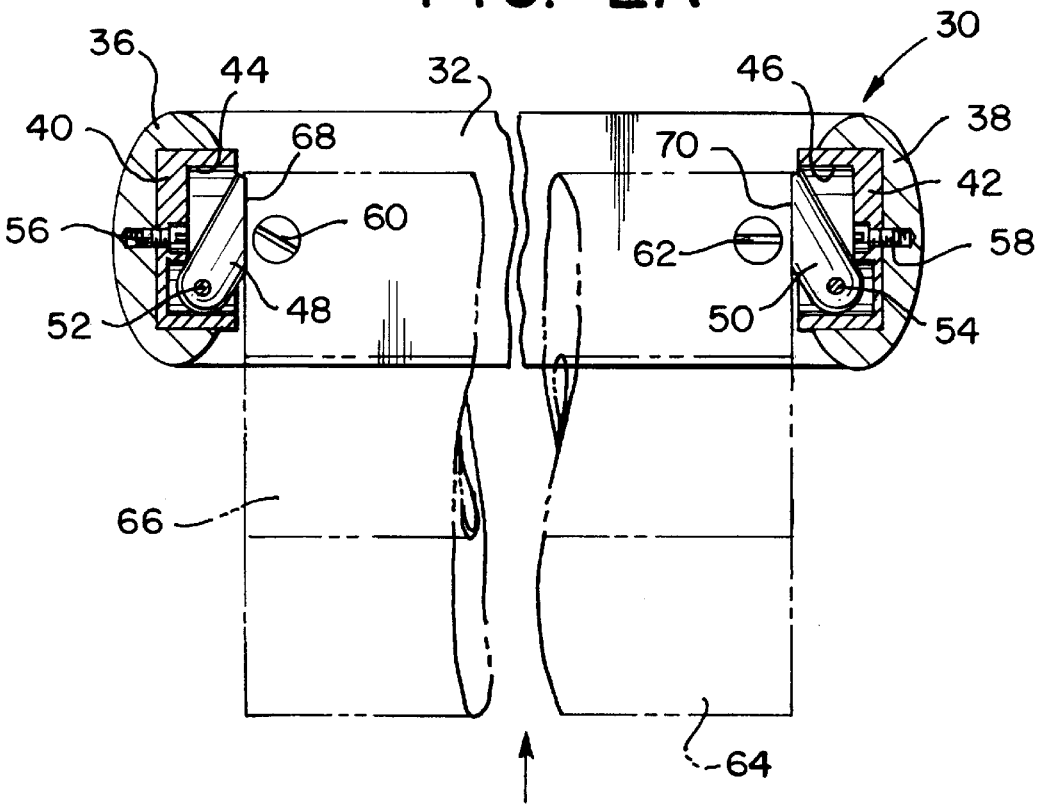
FIG. 2A is front cross-sectional view of the disclosed holder along lines 2—2 of FIG. 1 configured for horizontal mounting with a roll of material being loaded on the holder.

Referring to FIG. 1 in conjunction with FIG. 2A, the side frame members 36, 38 have cavities within which base members 40, 42 are mounted. The shapes of the base members 40, 42 and corresponding cavities may be complementary so that the base members 40, 42 fit into the cavities. In the preferred embodiment, the cavities and the base members 40, 42 are generally cylindrical with circular cross-sections and with nearly identical diameters, with the base member 40, 42 being disks, so that the base members 40, 42 may be positioned and fit into the cavities and may be rotated within the cavities about respective central axes to any angular orientation.

The base members 40, 42 include recesses 44, 46 in which arms 48, 50 are pivotally mounted by pins or axles 52, 54. The base members 40, 42 include screw holes for allowing screws 56, 58 to secure the base members 40, 42 to the side frame members 36, 38. In addition, screws 60, 62 are positioned in the screw holes 34 of the mounting plate 32 to secure the holder 30 to a surface.

As shown in FIG. 2A, the arms 48, 50 are capable of pivoting upward to allow a roll 64 of material having a cylindrical core 66 (shown in phantom) to be inserted between the side frame members 36, 38 by vertically moving the roll 64 upward in the direction of the arrow. The arms 48, 50 have lower surfaces 68, 70 which may be oriented to be vertical when the arms 48, 50 are pivoted upward while the roll 64 is moved upward during insertion. In order to be vertically oriented during insertion, the lower surfaces 68, 70 may be angled with respect to the upper surfaces 72, 74, so that the arms 48, 50 are not required to be completely retracted into the recesses 44, 46. The upper surfaces 72, 74 are oriented to be horizontal when the arms 48, 50 are pivoted downward, as shown in FIGS. 1 and 2B. The upper surfaces 72, 74 may be smooth and/or curved to reduce friction when the roll 64 is rotated to dispense the material.

Referring to FIG. 2B, the roll 64 having its core 66 is loaded onto the holder 30. The arms 48, 50 are pivoted downward in a horizonal orientation, and opposing ends of the core 66 rest upon the upper surfaces 72, 74. The smooth and/or curved upper surfaces 72, 74 allow the roll 64 to rotate with reduced friction for dispensing the material. A spring or other devices for providing a restoring force may be included to pivot the arms 40, 42 back to the horizontal position shown in FIGS. 1 and 2B.

As shown in FIG. 2C, after the material is sufficiently or completely dispensed from the core 66, the core 66 is removed from the holder 30 by lifting the core 66 upward, in the direction of the arrow, which causes the arms 48, 50 to pivot upward. The lower surfaces 68, 70 of the arms 48, 50 are oriented to be vertical as the core 66 is lifted.

FIG. 3 illustrates a cross-sectional view of the holder 30 along lines 3—3 shown in FIG. 2B with respect to the side frame member 36 and its related components. It is understood that, since the holder 30 is symmetrical, the side frame member 38 has identical components as the side frame member 36 described with respect to FIG. 3. As shown in FIG. 3, the side frame member 36 includes an elongated aperture 76 which allows a screw 78 to be inserted and screwed into a screw hole 80. The tip of the screw 78 engages a first orientation notch 82 to fix the orientation of the base member 40 for horizontally mounting the roll 64, as shown in FIGS. 1 and 2A–2C. The base member 40 may also include at least a second orientation notch 84 to fix the orientation of the base member 40 for vertically mounting the roll 64, as described below with reference to FIGS. 6–7. In the preferred embodiment, the orientation notches 82, 84 are positioned about 90° apart around the circumference of the base member 40.

Referring to FIG. 3, the side frame member 36 is mounted to the mounting plate 32 by screws 86, 88 extending through screw holes in the mounting plate 32. The mounting plate 32 may include an aperture 90 adjacent to the aperture 76 to allow the orientation of the base member 40 to be secured by the screw 78 through the aperture 76 after the side frame member 36 is mounted to the mounting plate 32. Alternatively, the mounting plate 32 may lack the aperture 90, so that the orientation of the base member 40 is to be secured through the aperture 76 before the side frame member 36 is mounted to the mounting plate 32 by the screws 86, 88.

FIG. 4 is a side cross-sectional view of a mid-section of the holder 30 along lines 4—4 shown in FIG. 2B, with a roll 64 loaded into the holder 30 and resting upon the arms 48, 50. The holder 30 is mounted horizontally, with the mounting plate 32 secured to a vertical surface 92, for example, a wall by screws 60, 62 through the screw holes 34.

As shown in FIG. 5, the side frame members 36, 38 are secured to the mounting plate 32 at a joint. For example, the side frame member 36 has a screw hole 94 in which the screw 86 is screwed to secure the side frame member 36 and the mounting plate 32 together.

In an alternative configuration shown in FIGS. 6–7, the holder 30 is oriented vertically to hold a roll 64 of material for dispensing. The holder 30 is mounted by the mounting plate 32 to a horizontal surface 96, for example, the underside of a kitchen cabinet. The base member 40 is rotated and secured by the screw 78 which engages the second orientation notch 84 in the base member 40. With the screw 78 in the second orientation notch 84, the base member 40 is oriented with its recess 44 extending vertically, so that the arm 48 may pivot vertically about the pin 52.

Accordingly, using the rotatable base members 40, 42 which are secured by the orientation notches 82, 84, when the holder 30 is mounted either horizontally or vertically, the base members 40, 42 and the arms 48, 50 may always be oriented vertically to allow the roll 64 to be vertically inserted, held, and removed. The roll 64 is positioned to rest upon the smooth and/or curved surfaces 72, 74 of the arms 48, 50 to rotate with reduced friction to dispense the rolled material from the roll 64.

While the disclosed rolled material holder is particularly shown and described herein with reference to the preferred embodiments, it is to be understood that various modifications in form and detail may be made without departing from the scope and spirit of the present invention. Accordingly, modifications described in connection with any examples suggested herein, but not limited thereto, are to be considered within the scope of the present invention.

What is claimed is:

1. A holder for holding a roll of material at opposing open ends and selectively mountable on a horizontal or vertical surface, the holder comprising:

a pair of oppositely positioned elongated side frame members, each side frame member having a rear mounting surface, an inwardly extending cavity in a side surface which is opposite the other side frame member, and an elongated aperture extending from the mounting surface to the cavity;

a pair of base members, each base member having an elongated recess and being disposed within a respective cavity of the side frame members, wherein the cavities and the base member are structured such that each of the base members has a selectable orientation within the respective cavity of the side frame members, wherein each base member includes a screw extending through each elongated aperture to engage and secure each of the base members oriented for vertical or horizontal mounting, and a cylindrical arm rotatably mounted in a lower portion of the elongated recess of each base member and movable under the influence of gravity from a stowed position in which the arm is stowed within the recess, to a roll supporting position in which the arm extends generally transverse to the respective side frame member.

2. The holder of claim 1 wherein each cylindrical arm includes a cylindrical surface and a planar surface oriented at an angle to the cylindrical surface, wherein the planar surface is oriented vertically when the cylindrical arm is in the stowed position, and wherein the vertically-oriented planar surface slidably engages the open ends of the roll of material as the roll of material is loaded or unloaded from the holder.

3. The holder of claim 1 wherein each inwardly extending cavity of the side frame members has a cylindrical shape; and wherein each of the base members has a cylindrical shape dimensioned to fit within the respective cylindrical-shaped cavity.

4. The holder of claim 3 wherein each base member includes an orientation notch positioned on the circumferential surface of the cylindrically-shaped base member and is rotatable to be positioned within the respective cylindrical cavity to a selected orientation to have the orientation notch in a predetermined securing position; and wherein each orientation notch engages the respective screw associated with a respective side frame member to secure the respective base member in the selected orientation within the cavity.

* * * * *